US010010996B2

(12) United States Patent
Moudry et al.

(10) Patent No.: US 10,010,996 B2
(45) Date of Patent: Jul. 3, 2018

(54) LAPPING PLATE AND METHOD OF MAKING

(71) Applicant: Seagate Technology LLC, Cupertino, CA (US)

(72) Inventors: Raymond Leroy Moudry, Bloomington, MN (US); Mihaela Ruxandra Baurceanu, Edina, MN (US); Joel William Hoehn, Hudson, WI (US); Andrew David Habermas, Bloomington, MN (US)

(73) Assignee: Seagate Technology LLC, Cupertino, CA (US)

( * ) Notice: Subject to any disclaimer, the term of this patent is extended or adjusted under 35 U.S.C. 154(b) by 147 days.

(21) Appl. No.: 15/133,415

(22) Filed: Apr. 20, 2016

(65) Prior Publication Data

US 2017/0304988 A1 Oct. 26, 2017

(51) Int. Cl.

| | |
|---|---|
| ***B24D 3/28*** | (2006.01) |
| ***B24B 37/14*** | (2012.01) |
| ***B24B 37/16*** | (2012.01) |
| ***B24D 18/00*** | (2006.01) |

(52) U.S. Cl.

CPC ..... *B24B 37/14* (2013.01); *B24B 37/16* (2013.01); *B24D 3/28* (2013.01); *B24D 18/00* (2013.01); *B24D 2203/00* (2013.01)

(58) Field of Classification Search

CPC ..... B24B 37/14; B24B 37/16; B24D 3/28; B24D 18/00

USPC ..... 451/529–550; 51/293, 298

See application file for complete search history.

(56) References Cited

U.S. PATENT DOCUMENTS

| | | | | |
|---|---|---|---|---|
| 3,864,101 | A * | 2/1975 | Charvat | B24D 3/28 51/293 |
| 4,588,420 | A * | 5/1986 | Charvat | B24D 13/00 264/162 |
| 4,866,886 | A | 9/1989 | Holmstrand | |
| 4,974,373 | A * | 12/1990 | Kawashima | B24D 3/28 51/293 |
| 5,089,032 | A * | 2/1992 | Moran | B24D 3/28 51/293 |
| 5,092,082 | A * | 3/1992 | Padberg | B24D 3/34 451/548 |
| 5,307,593 | A * | 5/1994 | Lucker | B24B 7/16 451/300 |
| 5,316,812 | A | 5/1994 | Stout et al. | |
| 5,405,648 | A | 4/1995 | Hermann | |
| 5,882,251 | A | 5/1999 | Berman et al. | |
| 6,099,394 | A * | 8/2000 | James | B24B 37/26 257/E21.23 |
| 6,568,992 | B1 | 5/2003 | Angelo et al. | |
| 6,802,761 | B1 | 10/2004 | Beaucage et al. | |

(Continued)

OTHER PUBLICATIONS

Moudry et al., U.S. Appl. No. 15/133,572, filed Apr. 20, 2016.

(Continued)

*Primary Examiner* — George Nguyen

(74) *Attorney, Agent, or Firm* — Kagan Binder, PLLC

(57) ABSTRACT

The present disclosure involves a method of making a lapping plate by coating a platen with solid resin powder, abrasive particles, and an aqueous carrier followed by evaporating the aqueous carrier and curing the solid resin powder to form an abrasive coating. The present disclosure also involves related lapping plates.

14 Claims, 7 Drawing Sheets

(56) References Cited

U.S. PATENT DOCUMENTS 6,951,506 B2 * 10/2005 Andideh ..... B24B 37/26 451/41
7,001,252 B2 2/2006 Hasegawa et al.
7,066,801 B2 * 6/2006 Balijepalli ..... B24D 3/32 451/41
7,235,296 B2 6/2007 Hunt et al.
7,275,311 B2 10/2007 Markevitch et al.
7,410,410 B2 8/2008 Mahadev et al.
7,470,171 B2 * 12/2008 Zhang ..... B24B 37/005 438/690
7,562,435 B2 7/2009 Mahadev et al.
8,480,772 B2 7/2013 Welygan et al.
8,545,583 B2 * 10/2013 Duescher ..... B24D 11/00 451/527
8,708,781 B2 * 4/2014 Hamilton ..... B24B 19/16 451/178
9,149,904 B1 * 10/2015 Moudry ..... B24B 37/12
9,205,530 B2 12/2015 Moudry et al.
9,403,258 B2 * 8/2016 Moudry ..... B24B 37/12
2002/0069592 A1 6/2002 Sherman et al.
2003/0200041 A1 10/2003 Church et al.
2004/0111975 A1 6/2004 Suman
2006/0122287 A1 * 6/2006 Yamamoto ..... B24B 37/24 521/163
2007/0020457 A1 1/2007 Adefris
2008/0122134 A1 * 5/2008 Michael ..... B29C 67/246 264/115
2010/0003904 A1 * 1/2010 Duescher ..... B24B 37/14 451/259
2010/0139174 A1 * 6/2010 Sung ..... B24B 7/228 51/297
2011/0092137 A1 4/2011 Ohishi et al.
2011/0233562 A1 9/2011 Harada et al.
2012/0248616 A1 * 10/2012 Kitajima ..... H05K 3/284 257/772
2014/0170944 A1 6/2014 Moudry et al.
2015/0000202 A1 1/2015 Moudry et al.
2015/0017883 A1 1/2015 Ronshaugen et al.

OTHER PUBLICATIONS

Liquid 2 Powder (1 Pint), SpectraCoat by Powder Buy The Pound, retrieved from http://www.powderbuythepound.com/LIQUID_2_POWDER_-1_PINT/, 8 pages.

PBTB—Liquid 2 Powder, PowderBuyThePound.com Material Safety Data Sheet, retrieved from https://www.powderbuythepound.com/pdf/MSDS%20L20.pdf, Revision date Dec. 10, 2009, 3 pages.

* cited by examiner

LAPPING PLATE AND METHOD OF MAKING

BACKGROUND

The present disclosure relates to lapping plates and methods of making lapping plates that can be used to lap (abrade) one or more bars of sliders. Sliders can be made out of ceramic material such as a two phase mixture of alumina and titanium-oxide (also referred to as AlTiC).

SUMMARY

Embodiments of the present disclosure include a method of forming a lapping plate including an abrasive coating on a surface of a platen, wherein the method includes:

a) forming a layer of an aqueous composition on the surface of the platen, wherein the layer of aqueous composition comprises a solid resin powder, a plurality of solid abrasive particles, and an aqueous carrier;

b) evaporating the aqueous carrier; and c) substantially curing the solid resin powder to form an abrasive coating comprising the solid abrasive particles and the cured resin.

Embodiments of the present disclosure also include a lapping plate including:

a) a platen having a surface; and b) an abrasive coating on at least a portion of the surface of the platen, wherein the abrasive coating comprises a plurality of abrasive particles adhered to the platen by a cured resin, wherein the cured resin is derived from one or more solid resin powders selected from the group consisting of solid epoxy resin powder, solid vinyl resin powder, solid polyester resin powder, and blends thereof.

DETAILED DESCRIPTION

Figure 1:
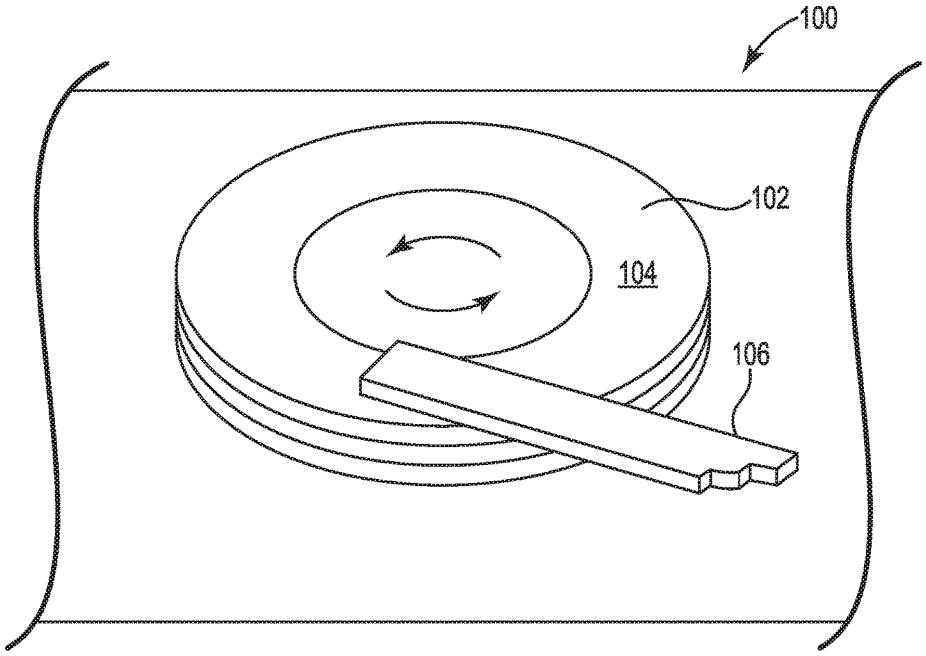
FIG. 1 is a schematic perspective view showing a lapping plate in a portion of a lapping tool.

A lapping plate according to the present disclosure can be used in a lapping tool to abrade the surface of a slider (e.g., an air bearing surface). FIG. 1 diagrammatically depicts a lapping tool 100 used for machining a surface of a slider. The tool 100 has a rotating lapping plate 102 defining a lapping surface 104 which can help abrade the surface of a ceramic material such as AlTiC. If desired, a slurry can be applied to the lapping surface 104 to enhance the abrading action as the lapping surface 104 is rotated relative to a slider bar 106 containing a plurality of the sliders held in a pressing engagement against the lapping surface 104. A lapping plate according to the present disclosure can be used for a variety of lapping processes such as rough lapping, fine lapping, and kiss lapping.

Embodiments of the present disclosure include a method of forming a lapping plate, where the method includes: a) forming a layer of an aqueous composition on the surface of the platen; b) evaporating the aqueous carrier; and c) substantially curing the solid resin powder to form an abrasive coating comprising the solid abrasive particles and the cured resin. For illustration purposes, an example of forming a lapping plate according to the present disclosure is described herein throughout with reference to FIGS. 2-3B.

Figure 3A:
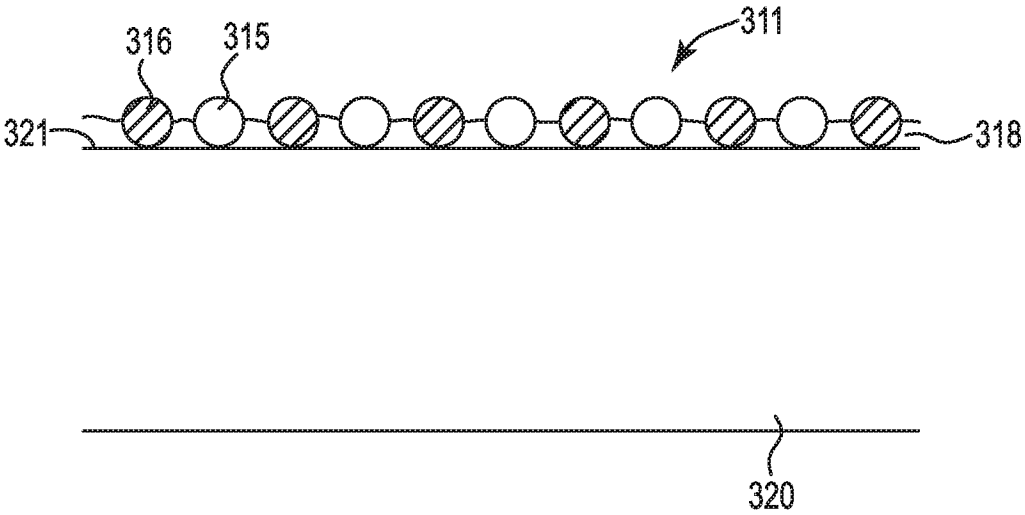
FIG. 3A is a cross-sectional view of a platen having a layer of solid resin powder, abrasive particles, and an aqueous carrier that have been applied to the surface of the platen.
Figure 3B:
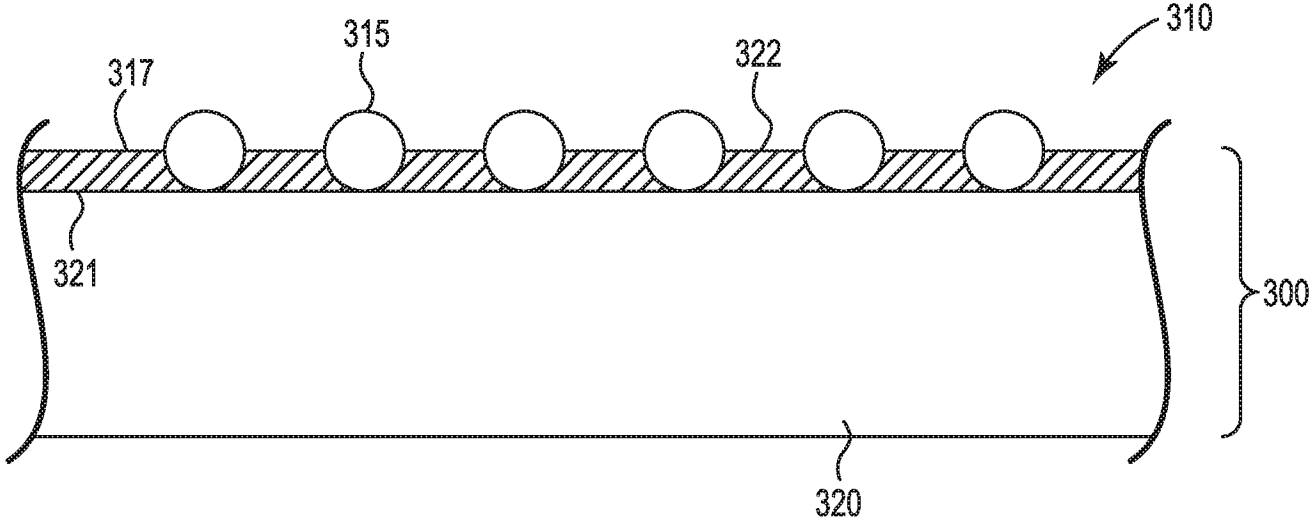
FIG. 3B is a cross-sectional view of FIG. 3A after the aqueous carrier has been evaporated and the solid resin powder has been cured to form an abrasive coating.

As shown in FIG. 3B, an embodiment of a lapping plate 300 according to the present disclosure includes a platen 320 having a surface 321 and an abrasive coating 310 on at least a portion of the surface 321 of the platen 320. The abrasive coating 310 includes a plurality of abrasive particles 315 adhered to the platen 320 by a cured resin 317.

A platen according to the present disclosure can be made of one or more layers and/or of one or more materials in each layer. As discussed below, abrasive particles, solid resin powder, and an aqueous carrier can be applied to a surface of a platen. In some embodiments, a platen according to the present disclosure can be made out of one or more materials such as plastic, metals, and the like. In some embodiments, at least the surface that the abrasive particles, solid resin powder, and aqueous carrier are applied to is made out of one or more metals. Exemplary metals include at least one of tin, tin alloy, aluminum, copper, combinations of these, and the like.

Figure 2:
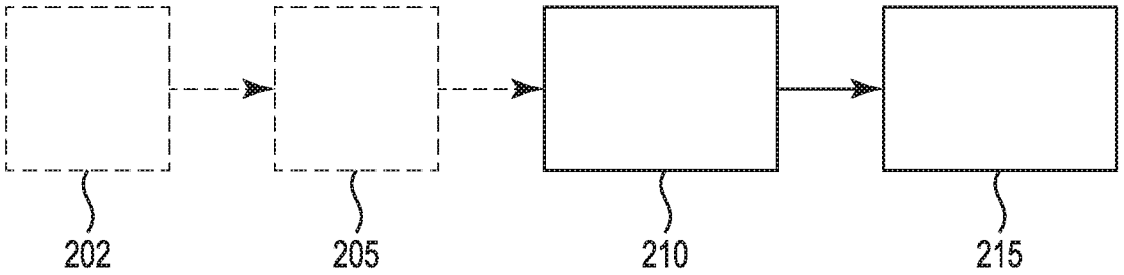
FIG. 2 is a process flow diagram illustrating an embodiment of the present disclosure.

Optionally, the surface 321 of platen 320 can be cut at step 202 in FIG. 2 to expose a fresh surface for forming abrasive coating 310.

Optionally, the surface 321 of platen 320 can be patterned at step 205 in FIG. 2 prior to forming abrasive coating 310 on the platen 320. As used herein, "patterning" surface means removing material from at least the surface of a platen to interrupt the surface and form a three-dimensional topography including plateaus or land areas, and cavities or channels (e.g., grooves). Advantageously, interrupting the surface of a platen in the form of a pattern as described herein can provide one or more channels for "swarf" (i.e., material that is lapped from a bar of sliders) and/or lapping lubricant to be contained and/or reduce friction between the bar of sliders and the lapping plate during lapping. Also, interrupting the surface of a platen in the form of a pattern can reduce hydroplaning of a slider bar on lapping lubricant. A wide variety of patterns can be used. For example, a pattern can include concentric grooves, spiral grooves, and/or radial grooves. A pattern can include cavities and/or grooves having vertical side walls (e.g., vertical sidewalls 353), sloped sidewalls, and/or rounded sidewalls. The cross-sectional geometry of a groove or channel can be fixed along its length or vary along its length. In some embodiments, a pattern can include a plurality of grooves that are spaced apart from each other a distance in the range from 10 to 300 micrometers. In some embodiments, a pattern can include a plurality of grooves having a depth in the range from 10 to 100 micrometers.

Figure 3C:
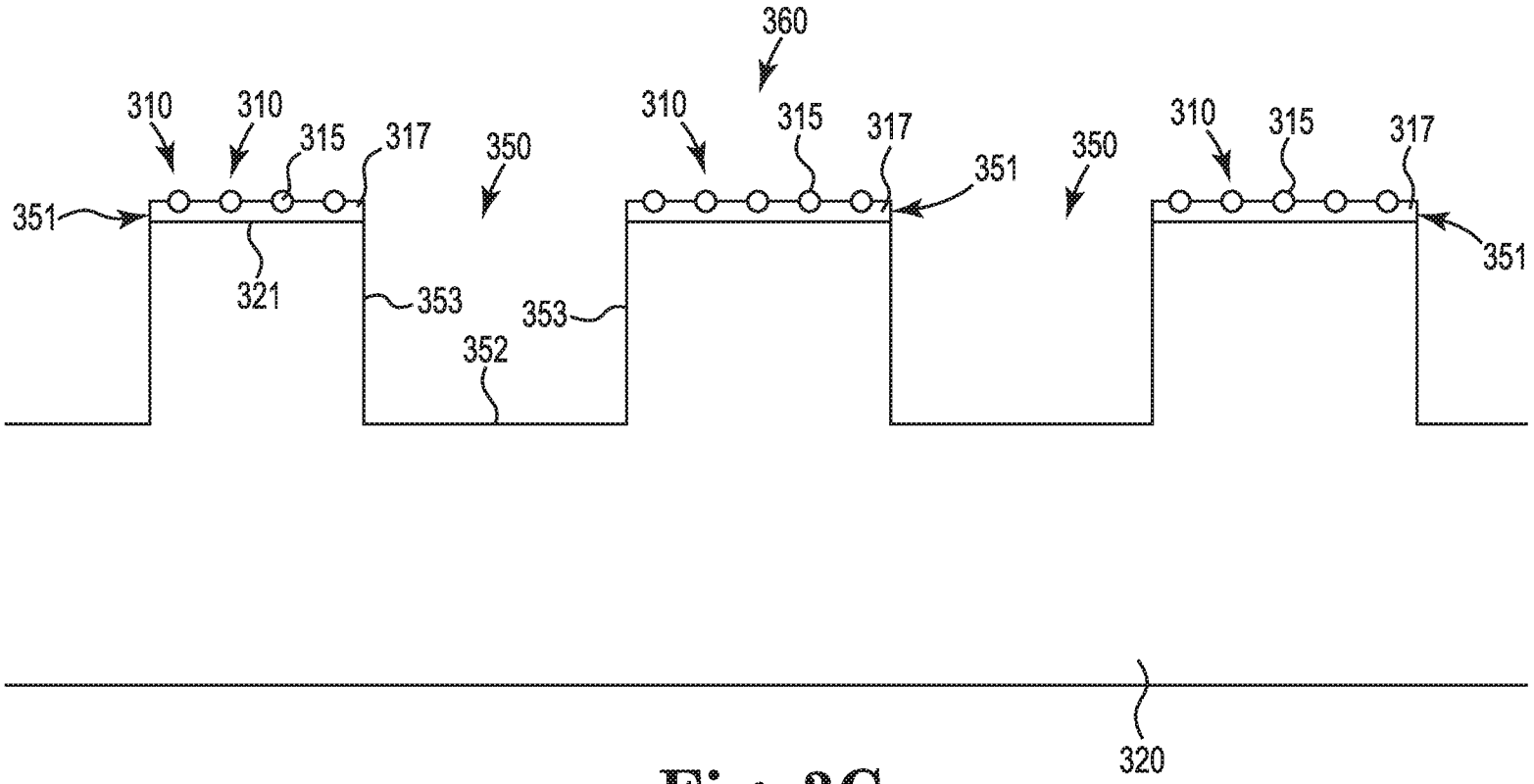
FIG. 3C is a cross-sectional view of an alternative embodiment of a lapping plate according to the present disclosure.

As shown in FIGS. 2 and 3C, the surface 321 of platen 320 can be patterned at step 205 prior to coating the platen 320 with abrasive coating 310. Patterning surface 321 includes removing material from the surface 321 to interrupt surface 321 as illustrated in FIG. 3C to define one or more grooves 350 having a base 352 and sidewalls 353, thereby defining a plurality of land areas 351 having abrasive coating 310. The sidewalls 353 defining land areas 351 desirably have a height that is greater than the thickness of abrasive coating 310 so that the pattern 360 transfers to the final lapping surface.

A pattern can also include a plurality of discrete structures on the surface of a platen such as recesses and/or protrusions (e.g., microopillar structures). Such structures can have a wide variety of shapes and sizes. Exemplary shapes include one or more of round, elliptical, and/or polygonal. The structures can all have the same shape and size and be equally spaced apart from each other in uniform manner or the structures can have a plurality of different shapes and sizes and be arranged in a random manner. Varying the geometry and pitch of the structures within a pattern can improve the lapping rate and throughput and/or reduce, or eliminate, a portion or all of the plate pattern from being transferred to an air bearing surface during lapping. The density of the structures can be uniform or vary across the surface of a platen.

Patterns as described herein can be positioned at one or more portions of a platen or be positioned across the entire surface of a platen.

Patterning a platen can be performed using a variety of techniques such as skiving, knurling, cutting, punch press, laser micromachining, lithography followed by dry or wet etching, and combinations thereof. An example of forming grooves 350 and land areas 351 using a toothed patterning tool is described in U.S. Pub. No. 2014/0170944 (Moudry et al.), the entirety of which publication is incorporated herein by reference.

As shown, base 352 may have no abrasive coating 310 thereon due to additional patterning after abrasive coating 310 has been applied (discussed below) to the platen 320 and that may cause any abrasive coating 310 that was present on base 352 to be removed, e.g., due to skiving and the like.

Optionally, the lapping plate 300 can be patterned (not shown) by forming a pattern in the abrasive coating 310. Advantageously, such a pattern can provide a pathway for "swarf" (i.e., material that is lapped from a bar of sliders) and/or lapping lubricant to be contained and/or centrifugally removed from the lapping plate during lapping. Also, interrupting the abrasive coating surface with a pattern can reduce hydroplaning of a slider bar on lapping lubricant. Patterning a pattern into abrasive coating 310 can be done by a variety of techniques such as additive techniques, subtractive techniques, and combinations thereof. For example, an additive technique can involve applying a mask on the platen before applying the abrasive coating or by photolithography lift-off techniques. As another example, subtractive techniques can involve pattering the abrasive coating 310 after it has been formed by skiving, knurling, punch press cutting, laser micromachining, or etching. Etching can include dry etching (e.g., ion-milling, reactive ion-etch, or other vacuum techniques) or wet etching (e.g., using etching media such as chlorinated solvents, sulfuric acid solutions, etc.).

As shown in FIG. 2, after optional treatments 202 and 205 (as indicated by dashed lines), a layer of an aqueous composition can be formed 210 on the surface of the platen. The aqueous composition can include a solid resin powder, a plurality of solid abrasive particles, and an aqueous carrier, and optionally one or more additives.

Solid resin powder according to the present disclosure can include a solid resin powder that can be applied to at least a portion of the surface of a platen and subsequently cured so that the solid, uncured resin powder melts and flows to form, along with abrasive particles, a continuous cured coating suitable for lapping a bar of sliders. Because the resin powder is solid, it can be applied to the surface of a platen in solid form. Advantageously, liquid resins can be avoided if desired. An example of a liquid resin is a two-part liquid epoxy system that can involve three or more steps with respect to applying the two-part liquid epoxy resin system and the abrasive particles. For example, two part epoxy systems can involve applying the first part of the epoxy to the surface of a platen, followed by applying the second part of the epoxy system (also referred to as a "hardener," "co-reactant," or "curative"), and lastly applying the abrasive particles. Such a three-step process can take an undue amount of time and can introduce undue non-uniformities in the final abrasive coating of the lapping plate because the epoxy and co-reactant may not uniformly mix across the surface of the platen. Such non-uniform coating can cause incomplete curing, thereby causing low rates of lapping. Further, because of the reactivity between the first and second parts of a two-part epoxy system, such systems often involve separate storing containers, separate dispensing equipment, and the like. As discussed below, in some embodiments according to the present disclosure the solid resin powder, abrasive particles, and aqueous carrier can be applied to a platen in a single step, thereby saving time and/or improving coating uniformity. Also, co-reactants in two-part liquid epoxy resin systems can be corrosive, thereby limiting the material selection for the coating equipment. Co-reactants can also be sensitive to carbon dioxide gas (e.g., in the atmosphere). For example, atmospheric carbon dioxide can react with some co-reactants, thereby impacting curing of the epoxy to an undue degree. Also the reaction between atmospheric carbon dioxide and some co-reactants can generate one or more byproducts that tend to clog coating equipment to an undue degree.

A solid resin powder can be selected based on one or more of its characteristics such as how the resin performs in forming a coating on a platen, how the resin performs in an abrasive coating during lapping, combinations of these, and the like. For example, a resin powder can be selected to help provide the abrasive coating with desirable chemical and mechanical resistance during lapping. As another example, a solid resin powder can be selected based on one or more of average particle diameter, particle density, and overall amount by weight to be used so that the solid resin powder interacts with the abrasive particles and aqueous carrier in a desired manner during application and in the final coating (further discussed below).

Solid resin powder can have an average particle diameter that permits the solid resin powder to be applied to a platen in a desirable manner. For example, the average particle diameter can be a size that permits the solid resin powder to be handled and dispensed (e.g., sprayed) by equipment discussed below. In some embodiments, solid resin powder can have an average particle diameter in the range from 0.1 to 100 micrometers, from 0.1 to 20 micrometers, or even from 0.1 to 5 micrometers.

Solid resin powder can have a particle density that permits the solid resin powder to be applied to a platen in a desirable manner. In some embodiments, solid resin powder can have a particle density in the range from 0.5 to 50 grams per cubic centimeter, from 0.5 to 20 grams per cubic centimeter, or even from 1 to 10 grams per cubic centimeter.

A solid resin powder can be made out of one or more materials from among a wide variety of chemistries. In some embodiments, a solid resin powder includes thermosetting solid resin powder. In some embodiments, a solid resin powder is selected from the group consisting of solid epoxy resin powder, solid vinyl resin powder, solid polyester resin powder, and blends thereof. In some embodiments, the solid resin powder is polyester resin. Exemplary solid resin powder is commercially available under the tradename 1 Coat Silver polyester resin powder from NIC Industries, White City, Oreg., or the tradename Epoxy Primer epoxy resin powder from NIC Industries, White City, Oreg. Advantageously, because the resin powder is a solid, the selection of resins can be expanded. For example, when using liquid resins, the selection of resins can be relatively limited because of resin viscosity when coating a platen with the resin. Some liquid resins such as two-part liquid epoxy systems may include epoxy resins having relatively short-chains so as to provide low viscosity of the resin during application of the resin to a platen. Such short-chain resins can impact one or more properties in the final abrasive coating (e.g., hardness, chemical resistance, and/or mechanical resistance) to an undue degree. Also, two-part liquid epoxy systems may include organic solvents to, e.g., help provide a desirable viscosity to the resin so that it can be applied to a platen in a desirable manner and/or as a carrier for abrasive particles. By using solid resin powder, organic solvents can advantageously be avoided if desired. For example, some solvents such as IPA are volatile at coating conditions such that IPA can evaporate to an undue degree and cause plugging of spray equipment and the like. In addition, organic solvents can evaporate in a manner that causes the amount of liquid resin or abrasive particles to vary from one deposition to another, thereby resulting in inconsistent quality from lapping plate to lapping plate. Also, too much IPA can interfere with curing to an undue degree.

A plurality of abrasive particles according to the present disclosure can include abrasive particles than can be applied to at least a portion of the surface of a platen and form, along with cured resin, an abrasive coating suitable for lapping a bar of sliders.

Abrasive particles can be selected based on one or more of their characteristics such as how the abrasive particles influence the forming of the abrasive coating on a platen, how the abrasive particles perform in an abrasive coating during lapping, combinations of these, and the like. For example, abrasive particles can be selected to help provide the abrasive coating with desirable abrading characteristics during lapping. As another example, abrasive particles can be selected based on one or more of average particle diameter, particle density, and overall amount by weight to be used so that the abrasive particles interact with the solid resin powder and/or aqueous carrier in a desired manner. For example, one or more of average particle diameter, particle density, and overall amount of each of the solid resin powder and abrasive particles can be selected to help prevent either the abrasive or resin from settling out of a mixture of the two in an aqueous carrier (e.g., during mixing, storing (e.g., in a container), during application to a platen, or while on the surface of a platen). Advantageously, as compared to applying liquid resins to a platen as a liquid, solid resin powder permits relative settling among the resin and abrasive particles to be controlled by selecting appropriate properties such as one or more of average particle diameter and particle density of each of the solid resin powder and abrasive particles. With respect to liquid resins, abrasive particles (e.g., diamond beads such as encapsulated diamond beads) can be denser than the liquid resin and can settle through a relatively thick layer of liquid resin. For example, the abrasive particles can settle toward the bottom of the layer of liquid resin such that they are submerged or do not sufficiently protrude through the layer of cured resin, thereby impacting the abrasive quality (e.g., lap rate) of the coating to an undue degree.

Abrasive particles can have an average particle diameter that permits the abrasive particles to be applied to a platen in a desirable manner. The average particle diameter of the abrasive particles can be selected depending on whether lapping involves rough lapping, fine lapping, and/or kiss lapping. In some embodiments, the abrasive particles can have an average particle diameter in the range from 0.01 to 10 micrometers. In some embodiments, the abrasive particles can have an average particle diameter less than 0.1 micrometers (e.g., for "kiss" lapping). In some embodiments, the abrasive particles can have an average particle diameter in the range from 0.1 to 1 micrometers (e.g., for "fine" lapping). In still other embodiments, the abrasive particles can have an average particle diameter in the range from greater than 1 micrometer to 3 micrometers (e.g., for "rough" lapping).

Abrasive particles can have a particle density that permits the abrasive particles to be applied to a platen in a desirable manner. In some embodiments, the abrasive particles can have a particle density in the range from 0.5 to 50 grams per cubic centimeter, from 0.5 to 20 grams per cubic centimeter, or even from 1 to 10 grams per cubic centimeter.

Abrasive particles according to the present disclosure can be made out of one or more materials. In some embodiments, abrasive particles are selected from the group consisting of diamond particles, cubic boron nitride particles, alumina particles, alumina zirconia particles, silicon carbide particles, and combinations thereof. In some embodiments, abrasive particles can be embedded within a ceramic material such as embedded diamond particles (embedded abrasive particles can also be referred to as encapsulated or composite abrasive particles, or even abrasive beads). Embedded abrasive particles are larger in size as compared to bare abrasive particles because the abrasive particles are embedded within ceramic material. For example, in some embodiments, embedded abrasive particles can have an average particle diameter in the range from 10 to 50 micrometers.

An aqueous carrier can provide a medium for the solid resin powder and abrasive particles to be suspended so that the solid resin powder and abrasive particles can be applied (e.g., dispensed and/or sprayed) to a surface of a platen so as to form a layer so that the solid resin powder can eventually be cured to help form an abrasive coating.

An aqueous carrier can include at least water. In some embodiments, an aqueous carrier can include water and a dispersant. A dispersant can help facilitate dispersing the solid resin powder and/or abrasive particles in water so as to form a suspension of the solid resin powder and/or abrasive particles in liquid water. In some embodiments, a dispersant includes at least one surfactant. Exemplary surfactants include anionic surfactants, nonionic surfactants, and mixtures thereof.

A dispersant can be present in the aqueous carrier in a variety of amounts. In some embodiments, the dispersant can be present in the aqueous carrier in an amount of 10 percent or less by weight based on the total weight of the aqueous carrier, or even 5 percent or less by weight based on the total weight of the aqueous carrier.

In some embodiments, an aqueous carrier can include one or more organic solvents. An exemplary organic solvent includes 1-Methyl-2pyrrolidone (NMP). In some embodiments, the organic solvents can be included in an amount of 10 percent or less by weight based on the total weight of the aqueous carrier. In some embodiments, the organic solvents can be included in an amount of 5 percent or less by weight based on the total weight of the aqueous carrier. In some embodiments, the organic solvents can be included in an amount of 1 percent or less by weight based on the total weight of the aqueous carrier.

An example of an aqueous carrier suitable for forming a suspension of solid resin powder and abrasive particles is commercially available under the tradename "Liquid 2 Powder" from Powder Buy The Pound, Nolensville, Tenn.

If the abrasive particles and solid resin powder are applied to a platen sequentially, the aqueous carrier used with each of the abrasive particles and solid resin powder can be the same or different as long as each aqueous carrier is compatible with the other.

Each of the solid resin powder, plurality of abrasive particles, and aqueous carrier can be included in an aqueous composition in an amount so as to facilitate coating, while at the same time providing desirable coating properties for lapping. For example, each of the solid resin powder and the plurality of abrasive particles can be provided in an amount so that, as shown in FIG. 3B, at least a portion of abrasive particles 315 protrude above surface 322 of cured resin 317 to provide desired abrasive performance during lapping while at the same time providing desired service life before a new coating 310 is needed. In some embodiments, aqueous carrier and the total of of the solid resin powder and the plurality of abrasive particles are present in the aqueous composition in an amount so that the weight ratio of the total of the solid resin powder and plurality of abrasive particles to the aqueous carrier is in the range from 1 to 10, from 1 to 5, from 1 to 3, or even 1 to 1.2.

In some embodiments, each of the solid resin powder and the plurality of abrasive particles are present in an amount so that the weight ratio of the solid resin powder to the plurality of abrasive particles in the abrasive coating is in the range from 0.1 to 10, from 0.25 to 5, or even from 0.5 to 1.5.

One or more optional additives can be included in an aqueous composition and/or abrasive coating according to the present disclosure. Exemplary optional additives include fillers, pigments, and the like. An aqueous composition can be formed by a variety of techniques. For example, solid resin powder and/or a plurality of abrasive particles can be combined with an aqueous carrier and mixed so that the solid resin powder and/or abrasive particles become suspended in the aqueous carrier to form an aqueous composition that can be applied to a surface of a platen. The solid resin powder and a plurality of abrasive particles can be applied to the surface of the platen sequentially or as a mixture in a single step. In some embodiments, an aqueous composition that includes an aqueous carrier and both the solid resin powder and the plurality of solid abrasive particles (and one or more optional additives) can be applied to the surface of the platen in a single step. The aqueous composition can be applied to the platen immediately after forming the aqueous composition or stored for a period of time in a container. Being able to apply the solid resin powder and abrasive particles in a single step can advantageously avoid, if desired, manufacturing protocols that apply a resin and abrasive particles in two or more steps. For example, an abrasive coating made from a two part liquid epoxy system (resin plus hardener) can be formed by applying the first part epoxy, the second part hardener, and then the abrasive particles. Such a three step process can lead to increased process time, a non-uniform coating on a platen, and/or inconsistent coatings among multiple platens.

In some embodiments, the average particle diameter of each of the solid resin powder and the abrasive particles can be selected so that the ratio of the of the solid resin powder average particle diameter to the abrasive particles average particle diameter is in the range from 0.5:1 to 5:1, from 0.5:1 to 2:1, or even from 0.5:1 to 1.5:1.

In some embodiments, the particle density of each of the solid resin powder and the abrasive particles can be selected so that the ratio of the of the solid resin powder particle density to the abrasive particles particle density is in the range from 0.1 to 10, from 0.25 to 5, from 0.5 to 1.5, or even from 0.8 to 1.2.

As mentioned, in some embodiments, at least a portion of the solid resin powder can be applied to the surface of the platen followed by applying the plurality of abrasive particles to the surface of the platen. In some embodiments, a layer of an aqueous composition can be formed on the surface of the platen by applying a first aqueous composition on the surface of the platen, where the first aqueous composition includes solid resin powder and an aqueous carrier; and applying a second aqueous composition on the surface of the platen, where the second aqueous composition includes a plurality of solid abrasive particles and an aqueous carrier. The first aqueous composition can be applied to the surface of the platen before or after the second aqueous composition is applied to the surface of the platen.

Referring to FIG. 3A again, the aqueous carrier 318 solid resin powder 316 and a plurality of abrasive particles 315 can be applied to the surface 321 of the platen 320 to form a layer 311 on the surface 321 of the platen 320. It is noted that layer 311 is shown as a "monolayer" of solid resin powder and abrasive particles for illustration purposes. Layer 311 could be two or more layers thick of solid resin powder and abrasive particles.

A variety of techniques can be used to apply the aqueous carrier, the solid resin powder, the plurality of abrasive particles, and optional additives to a platen. For example, an aqueous composition can be applied to a platen using dispensing mechanisms, spraying mechanisms, combinations of these, and the like. For illustration purposes, the solid resin powder, abrasive particles, or mixture thereof, and aqueous carrier can pass through a spray gun and be deposited onto the platen surface.

As shown in FIG. 2, after forming a layer of the aqueous composition on the surface of the platen, embodiments of the present disclosure include evaporating the aqueous carrier and substantially curing 215 the solid resin powder to form an abrasive coating comprising the abrasive particles and the cured resin. The aqueous carrier can be evaporated prior to curing the solid resin powder or evaporation of the aqueous carrier can overlap at least partially with curing of the solid resin powder. Although a complete cure is desirable, a substantially cured resin means that the resin is cured to a degree in a practical sense to form an abrasive coating that is useful for lapping a slider bar. Referring to FIGS. 3A and 3B, the solid resin powder 316 is cured under conditions and for a time to cause the resin to flow and form cured resin 317 so as to form an abrasive coating 310.

In some embodiments, the aqueous composition may be at room temperature (e.g., from 20-30° C. ) prior evaporating the aqueous carrier. In some embodiments, the aqueous carrier can be evaporated by heating the aqueous composition to 100° C. or greater for a time such that substantially all of the aqueous carrier evaporates prior to the solid resin powder curing.

One or more types of curing can be used and may depend on the type of solid resin powder selected. Exemplary types of curing can be selected from the group consisting of thermal curing, ultraviolet curing, infrared curing, and combinations thereof.

In some embodiments, the aqueous carrier can be evaporated and the solid resin powder can be cured by heating the aqueous composition to a temperature in the range from 100° C. to 300° C., or even 110° C. to 200° C., for a time period in the range of 5 minutes to 3 hours, or even 30 minutes to 2 hours.

In some embodiments, at least a portion of the dispersant that may be present in an aqueous carrier can remain after evaporating the water in the aqueous carrier and curing the solid resin powder. This dispersant residue can be present in the final abrasive coating 310 without impacting lapping to an undue degree. In some embodiments, the dispersant residue includes a dispersant (e.g., surfactant) of the type and amount discussed above.

If desired, one or more additional layers similar to layer 311 can be applied to the platen and cured.

An abrasive coating such as coating 310 can have any desired thickness. In some embodiments, abrasive coating 310 has a thickness in the range from 0.5 to 100 micrometers.

EXAMPLE

This example compared rough lapping performed between two lapping plates. Lapping Plate #1 was made by coating a platen with an aqueous composition including thermosetting, solid resin powder, encapsulated diamond beads, and an aqueous carrier. Lapping Plate #2 was made by sequentially spray coating a liquid two-part epoxy and encapsulated diamond beads suspended in IPA. The results are shown in Table 1 below and are described in terms of a percentage increase or descrease of Lapping Plate #1 as compared to Lapping Plate #2. Table 1

| | Lapping Plate #1 |
|---|---|
| Stripe Height (SH) Sigma (nm) | 26% reduction in Sigma using Lapping Plate #1 |
| Bar crown inflation after simulation of bar-induced plate damage (uin) | 84% reduction in bar crown inflation using Lapping Plate #1 |
| Lap Rate | No change in Lap Rate using Lapping Plate #1 |

As shown in Table 1 above, the stripe height sigma and brown crown inflation were each advantageously reduced by 26 and 84%, respectively, while not sacrificing lap rate performance. Without being bound by theory, it is believed that such improved performance is due at least in part because the coating techniques described herein with solid resin powder permits the use of coating formulations that produce a relatively harder coating as compared to coatings made by spraying liquid epoxy resins. For example, as mentioned above, when using liquid resins, the selection of resins can be relatively limited because of resin viscosity required to coat a platen with the resin as a liquid. Making a coating relatively harder can make the coating more robust and less susceptible to damage, which can translate to more repeatable and uniform lapping.

Figure 4:
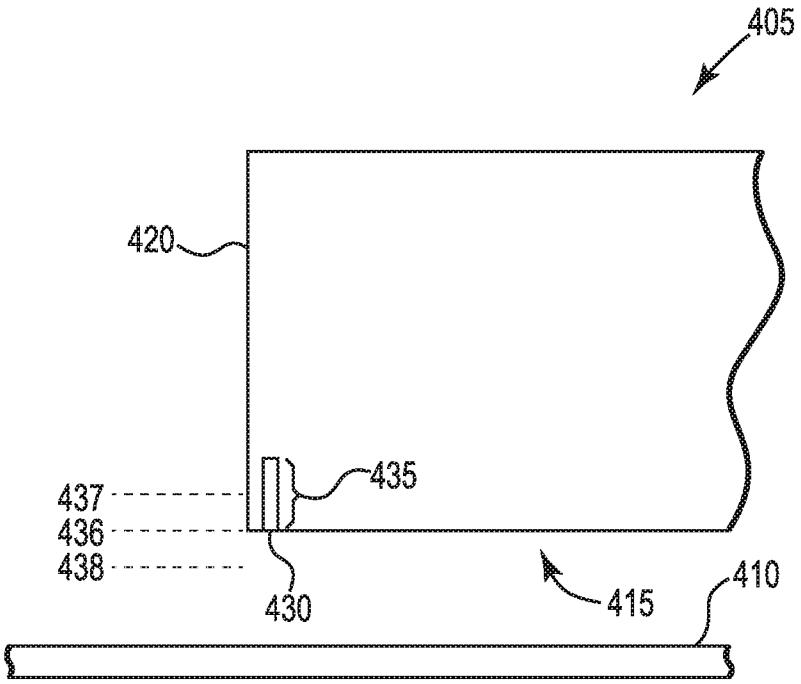
FIG. 4 is a cross-sectional elevation view of a slider positioned over a hard disc to illustrate stripe height.

Stripe height sigma is described below in connection with FIG. 4. As shown in FIG. 4, a slider 405 is positioned over a disc 410 so that an air bearing surface 415 faces the disc. The magnetoresistive element 430 is shown at the bottom of slider 405 proximal to air bearing surface 415. The magnetoresistive element 430 represents the portion of a magnetic read/write head which contains the read sensor and write poles. The magnetoresistive element 430 has a height 435, which is not to scale as shown in FIG. 4. The final height 435 of the magnetoresistive element 430 can be on the order of microns (typically less than a micrometer), whereas the height of the slider 405 can be several or more tenths of a millimeter. The magnetoresistive element 430 can be formed at the wafer level using a variety of, for instance, deposition and photolithography techniques. Multiple sliders 405, up to as many as 40,000, may be formed on one wafer. The wafer can be sliced into bars, where each bar can have up to 60-70 sliders. The bars can be lapped to finish or polish the surface what will eventually become the air bearing surface 415. As part of the lapping process, the magnetoresistive element 430 can be lapped until it reaches the desired stripe height 435.

Because stripe heights can be so small, minor variances in the stripe heights among the sliders of a bar can impact the signal from slider to slider. Thus, there is a desire to make the stripe heights as uniform as possible among the sliders of a bar. The standard deviation of the stripe heights (also referred to as "stripe height sigma") of a bar of sliders is a measure of how spread out the stripe height values are among the sliders of a bar. With reference to FIG. 4, a range of stripe heights can vary from an upper stripe height 438 (which may be "underlapped") to a lower stripe height 437 (which may be "overlapped"). Stripe height 436 can be a target stripe height.

Figure 5:
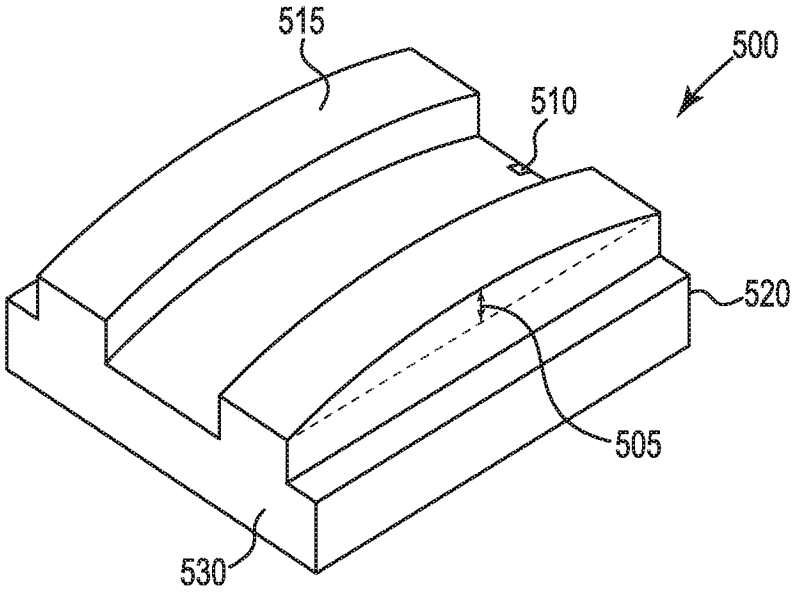
FIG. 5 is a perspective view of the air bearing surface of a slider to illustrate crown.

Bar crown inflation is described below in connection with FIG. 5. FIG. 5 shows a slider 500 with a leading edge 530, trailing edge 520, air bearing surface 515, and magnetoresistive element 510. The air bearing surface 515 can have a convex shape which is referred to the "crown" and represents the curvature that spans between the leading edge 530 and the trailing edge 520. The crown can have a curvature having a varying distance 505 relative to a flat, horizontal plane indicated by the dashed line. As a lapping plate is used to lap multiple bars, the lapping plate can be damaged during the process (e.g., due a bar of sliders dropping on the lapping plate). Such damage can cause one or more undulations in the surface of the lapping plate that contacts a bar of sliders during lapping. Such undulations can translate to the bar of sliders and cause the distance 505 to unintentionally increase (or "inflate").

What is claimed is:

1. A method of forming a lapping plate comprising an abrasive coating on a surface of a platen, wherein the method comprises:

a) forming a layer of an aqueous composition on the surface of the platen, wherein the layer of aqueous composition comprises a solid resin powder, a plurality of solid abrasive particles, and an aqueous carrier;

b) evaporating the aqueous carrier; and c) substantially curing the solid resin powder to form an abrasive coating comprising the solid abrasive particles and the cured resin.

2. The method of claim 1, wherein the aqueous carrier comprises water and a dispersant.

3. The method of claim 2, wherein the dispersant comprises a surfactant, and wherein the dispersant is present in an amount of 10 percent or less by weight based on the total weight of the aqueous carrier.

4. The method of claim 1, wherein forming a layer of an aqueous composition to the surface of the platen comprises spraying an aqueous composition on the surface of the platen, wherein the aqueous composition comprises the solid resin powder, the plurality of solid abrasive particles, and the aqueous carrier.

5. The method of claim 1, wherein forming a layer of an aqueous composition to the surface of the platen comprises:

a) spraying a first aqueous composition on the surface of the platen, wherein the first aqueous composition comprises the solid resin powder and the aqueous carrier; and b) spraying a second aqueous composition on the surface of the platen, wherein the second aqueous composition comprises the plurality of solid abrasive particles and the aqueous carrier, wherein step (a) occurs before step (b) or step (b) occurs before step (a).

6. The method of claim 1, wherein the solid resin powder has a particle density and the abrasive particles have a particle density, wherein the ratio of the of the solid resin powder particle density to the abrasive particles particle density is in the range from 0.1 to 10.

7. The method of claim 1, wherein the solid resin powder has an average particle diameter and the abrasive particles have an average particle diameter, wherein the ratio of the of the solid resin powder average particle diameter to the abrasive particles average particle diameter is in the range from 0.5:1 to 5:1.

8. The method of claim 2, wherein the solid resin powder and the plurality of abrasive particles are each present in the aqueous carrier in an amount so that the weight ratio of the solid resin powder to the plurality of abrasive particles is in the range from 0.1 to 10.

9. The method of claim 1, wherein the solid resin powder comprises thermosetting solid resin powder.

10. The method of claim 1, wherein the solid resin powder is selected from the group consisting of solid epoxy resin powder, solid vinyl resin powder, solid polyester resin powder, and blends thereof.

11. The method of claim 1, wherein curing is selected from the group consisting of thermal curing, ultraviolet curing, infrared curing, and combinations thereof.

12. The method of claim 1, wherein evaporating the aqueous carrier and substantially curing the solid resin powder comprises heating the aqueous composition to a temperature greater than 100° C. for a time period to form an abrasive coating comprising the solid abrasive particles and the cured resin.

13. The method of claim 1, wherein prior to step (a) the method further comprises patterning the surface of the platen, wherein patterning is selected from the group consisting of skiving, knurling, cutting, punch press, laser micromachining, lithography followed by dry or wet etching, and combinations thereof.

14. The method of claim 1, further comprising forming a pattern in the abrasive coating via additive patterning and/or subtractive patterning.

* * * * *